United States Patent [19]

Yu

[11] Patent Number: 4,961,056

[45] Date of Patent: Oct. 2, 1990

[54] RELATIVISTIC KLYSTRON DRIVEN COMPACT HIGH GRADIENT ACCELERATOR AS AN INJECTOR TO AN X-RAY SYNCHROTRON RADIATION RING

[76] Inventor: David U. L. Yu, 1912 MacArthur St., Rancho Palos Verdes, Calif. 90732

[21] Appl. No.: 406,594

[22] Filed: Sep. 13, 1989

[51] Int. Cl.[5] ..... H05H 7/00; H05H 13/04

[52] U.S. Cl. ..... 328/235; 315/5

[58] Field of Search ..... 328/232, 235; 378/119; 315/5

[56] References Cited

U.S. PATENT DOCUMENTS 4,740,973 4/1988 Rladey et al. ..... 315/5

OTHER PUBLICATIONS

"Relativistic Klystron Two-Beam Accelerator" by Sessler et al. *Physical Review Letters* (58) p. 2439 Jun. 1987.

*Primary Examiner*—Sandra L. O'Shea

*Attorney, Agent, or Firm*—Irving Keschner

[57] ABSTRACT

A compact high gradient accelerator driven by a relativistic klystron is utilized to inject high energy electrons into an X-ray synchrotron radiation ring. The high gradients provided by the relativistic klystron enables accelerator structure to be much shorter (typically 3 meters) than conventional injectors. This in turn enables manufacturers which utilize high energy, high intensity X-rays to produce various devices, such as computer chips, to do so on a cost effective basis.

9 Claims, 2 Drawing Sheets

RELATIVISTIC KLYSTRON DRIVEN COMPACT HIGH GRADIENT ACCELERATOR AS AN INJECTOR TO AN X-RAY SYNCHROTRON RADIATION RING

GOVERNMENT RIGHTS IN INVENTION

The invention was made with Government support under Small Business Innovation Research (SBIR) Contract No. DE-AC03-87ER 80529 awarded by the Department of Energy. The Government has certain rights in the invention.

BACKGROUND OF THE INVENTION

1. Field of the Invention

The present invention relates to compact apparatus for generating intense X-rays suitable for lithography and other uses.

2. Description of the Prior Art

The continuing improvement in the performance of integrated circuits has depended to a large extent on an ability to produce progressively finer features on the surface of a silicon wafer. Optical lithography has provided the main production tool for reproducing these fine features. It has been developed to a remarkable level of sophistication and can now produce line widths as narrow as 0.7 μm. Future developments in optical lithography are anticipated to reduce these line widths still further, but it is likely that progress below 0.5 μm will raise severe processing difficulties; progress below 0.3 μm will probably be impossible. X-ray lithography, on the other hand, offers the clear potential for resolving features as small as 0.1 μm. More importantly, at much larger feature sizes of 0.5 μm, it offers significant processing advantages over optical lithography. The most important of these are:

(a) large depth of focus ($\approx$ 40 μm);

(b) broad exposure latitude;

(c) broad processing latitude; and (d) relative insensitivity to dust particles.

The generation of X-rays for use in X-ray lithography is typically provided by apparatus which utilizes synchrotron radiation rings.

Synchrotron radiation output power is produced by bending a beam of electrons in a magnetic field. This emitted power is focussed in one plane so that a wafer stepper may be located at a comfortable distance from the source. In comparison with alternative sources, the conventional synchrotron produces an illumination at the wafer stepper about 500 times greater than a rotating anode X-ray source and at least 20 times greater than a laser plasma or gas puff plasma source. This high level of illumination brings obvious benefits for increasing the throughput in a manufacturing environment. Good mask lifetime is assured by the fact that, unlike laser or plasma source, synchrotrons produce no debris.

In most synchrotron X-ray sources, the electron beam is produced in a separate electron linear accelerator (the injector). The conventional accelerator produces a gradient on the order of 15–20 MeV/meter. A 200 MeV injector is thus about 10–14 meters long. Electrons from the injector are injected into the synchrotron ring where they are made to circulate in a closed orbit by a suitable arrangement of bending and focussing magnets. The electrons may then be accelerated to higher energy by feeding rf power to an accelerating cavity while simultaneously increasing the field in the magnets. At full energy, the magnets remain at fixed field and acceleration ceases, but rf power must still be fed to the cavity in order to make good the energy loss sustained by the electron beam in emitting X-rays. In this "stored beam" mode, the electron beam may continue to circulate for some time period, emitting a steady beam of X-rays. Eventually the electrons start to be lost via scattering by residual gas molecules in the vacuum chamber and it is necessary to abort the remaining beam and re-start the injection process.

Electron storage rings using conventional magnets are to be found in all major industrialized countries and have now been accepted sources of X-ray radiation for research in many areas of science. Unfortunately, such installations are too large for use in a microchip fabrication facility because the relatively low fields available from conventional bending magnets imply large bending radii for the stored electron beam and therefore a large perimeter for the closed orbit ring. The more powerful fields available from superconducting magnets can be used to produce a much more compact installation. An example of a commercially available superconducting synchrotron that produces a steady X-ray power output is the Helios model, currently under development by Oxford Industries, Oxford, England. Using superconducting magnets, the Helios model bends the electron beam around a radius of only 0.5 meters. To produce the same X-ray wavelengths using conventional magnets would require a bend radius of 3 meters. A superconducting ring can accommodate electrons injected at one third the energy of a conventional ring thus reducing the injector cost. Efficiency is also gained by reducing the overall size of the installation and the required thickness of shielding, the latter resulting from the reduced overall size of the superconducting synchrotron.

Although the use of the Helios type synchrotron ring significantly reduces the overall size of the installation, the size of the electron linear accelerator used as the injector is still very large (typically 10–14 meters). This severely limits the use of the apparatus in commercial microchip fabrication facilities where space availability is at a premium.

SUMMARY OF THE INVENTION

The present invention provides a compact apparatus for generating X-rays. The apparatus utilizes a relativistic klystron driven high gradient accelerator to inject high energy electrons into a superconducting magnetic storage ring. Passage of the electrons through the storage ring causes high intensity X-rays to be generated.

The relativistic klystron driven compact high gradient accelerator is coupled to synchrotron radiation rings to produce X-rays primarily for lithography use but can also be used in other applications, such as medical diagnosis and therapy. The relativistic klystron based linear accelerator replaces the conventional linear accelerator as an injector to a superconducting synchrotron radiation ring. There are several advantages in using this apparatus. First, because of the high gradients (on the order of 200 MeV/meter) achievable in the relativistic klystron driven high gradient accelerator, the compact structure is much shorter than conventional injectors. Secondly, a high intensity electron beam is obtained from the device. Thirdly, using the device in conjunction with the synchrotron radiation rings produces usable X-rays without additional complex devices such as free electron lasers or undulators, which are alternative devices for producing X-rays.

The apparatus is particularly useful in the semiconductor industry in that very large scale integrated circuits can be fabricated using X-ray lithography techniques on a cost effective basis. Chip manufacturers using the invention will have a significant cost advantage in the marketplace.

BRIEF DESCRIPTION OF THE DRAWING

For a better understanding of the invention as well as other objects and further features thereof, reference is made to the following description which is to be read in conjunction with the accompanying drawing wherein.

DESCRIPTION OF THE INVENTION

Figure 1:
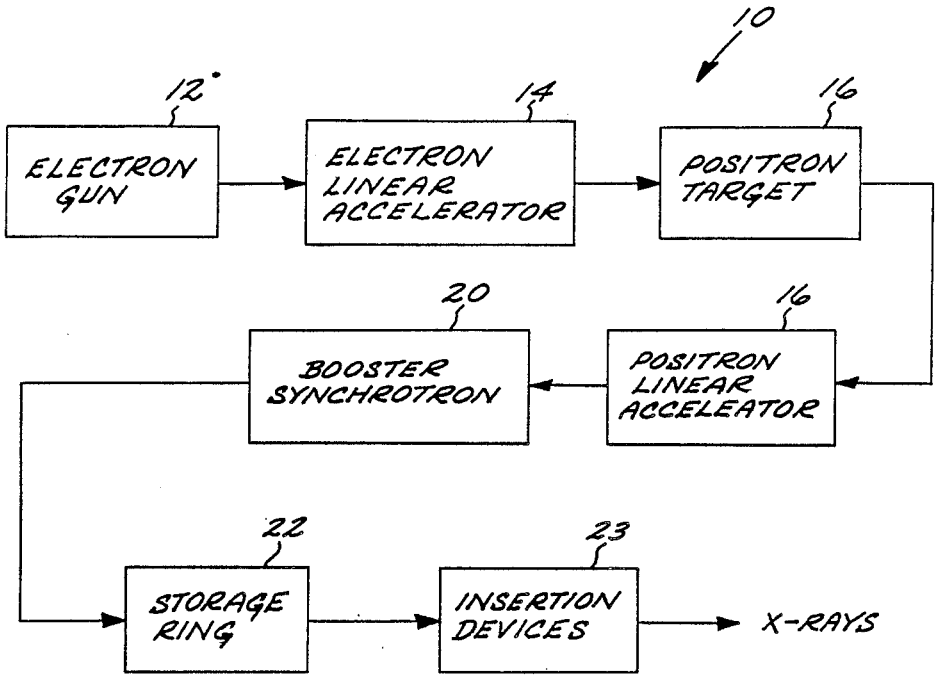
FIG. 1 is a block diagram of a prior art apparatus for generating X-rays for use in lithography.

FIG. 1 is a block diagram of a conventional prior art X-ray generation system 10, such as the system being currently constructed at the Argonne National Laboratory, Batavia, Ill., which can be used to make integrated circuits. An electron gun 12 produces electrons which are injected into an electron linear accelerator 14. Accelerator 14 boosts the electrons therein to a predetermined velocity and energy level which, when emitted, strike a positron target 16 and interact to produce electron-positron pairs. Positrons of appropriate energy are selected and injected into a positron linear accelerator 18 which raises the positron energies from 10 MeV to 450 MeV. The positrons are then injected into a booster synchrotron 20 where the positrons are rapidly accelerated to an energy level of 7 Gev and are then injected into a synchrotron storage ring 22 where the positrons are accumulated and stored in the storage ring, which is about ⅔ mile in circumference. Using magnets, the ring keeps stored positrons moving in a circular path. As their path is bent around the ring, the positrons emit X-rays. The ring's rf system makes up the energy lost through synchrotron radiation. The ring may also include a plurality of straight sections into which can be inserted devices 23, which are comprised of a series of short magnets with alternating magnetic fields The positrons are caused to undulate in the section, increasing the brilliance of the emitted X-rays.

Figure 2:
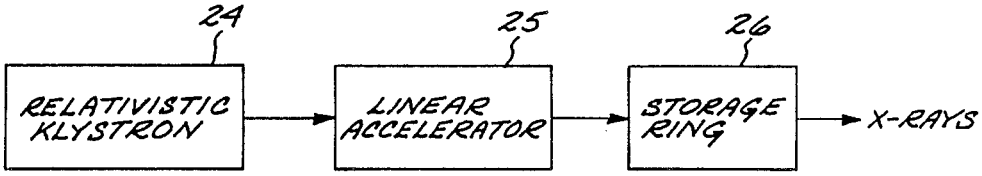
FIG. 2 is a block diagram of the present invention.

Referring now to FIG. 2, a block diagram of the present invention is illustrated.

In this invention, a relativistic klystron 24 is coupled to a high gradient accelerator 25, the accelerator injecting high energy electrons directly into a synchrotron storage ring 26 in which the X-rays are produced. In a preferred mode of operation, storage ring 26 is of a type using superconducting magnets such as the Helios model, manufactured by Oxford Instruments, Oxford, England. The advantages of using a synchrotron storage ring of the Helios type has been described hereinabove, including the fact that the overall physical size of the storage ring is much smaller than other conventional storage rings. It should be noted, however, that conventional storage rings can also be utilized in the present invention, including storage rings that are not designed to generate X-rays.

Figure 3:
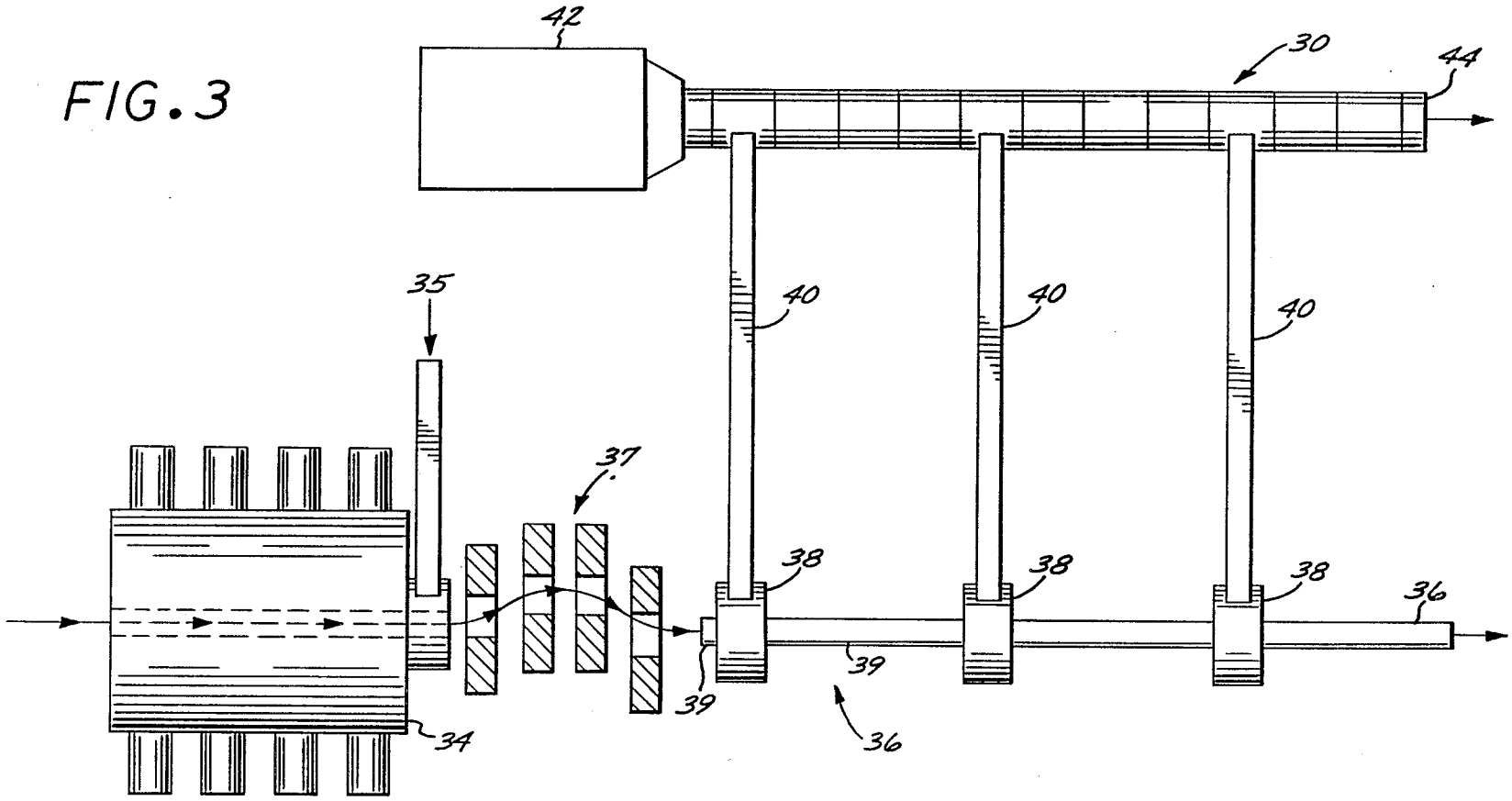
FIG. 3 is an exploded perspective view of a relativistic klystron utilized in the apparatus of the present invention.
Figure 1:
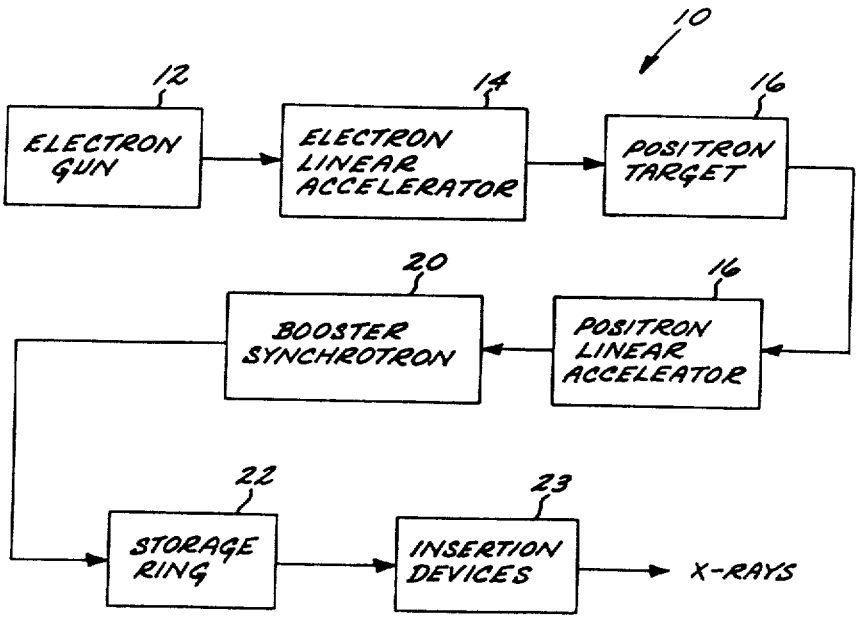
FIG. 1 PRIOR ART

The key feature of the present invention is the use of a relativistic klystron driven high gradient accelerator (RK/HGA) as an injector of high energy electrons into the synchrotron storage ring. FIG. 3 is a perspective view of a typical relativistic klystron device. The RK/HGA consists of a high gradient accelerating structure 30 which is periodically coupled to a source of high microwave power. The term "high gradient" as used in the accelerator art is used to characterize an accelerator structure which stores large amounts of energy per unit length. The necessary power, in accordance with the teachings of the present invention, is supplied by the relativistic klystron which converts a high power bunched electron beam from an induction linac 34 to microwaves. The relativistic klystron 36 is comprised of a direct rf drive 35, an electron buncher system 37 at the appropriate frequency, a drift tube 39 in which energy modulation converts into current modulation, and standing wave and/or traveling wave output cavities 38 where current modulation converts into high power output microwave radiation.

The use of relativistic klystron 36 as a microwave power source provides significant advantages over alternative sources, such as a free electron laser. In particular, relativistic klystron 36 provides a relatively simple technique for extracting rf power by means of the output cavities 38 and transporting the power to high gradient structure 30 via waveguides 40. This method provides rf phase stability as the phases of the microwaves, which are readily separated from the electron beam, can be easily controlled.

The relativistic klystron output cavities 38 extract the electromagnetic power. Since high frequencies are desirable in order to provide high energy gradients to the accelerating structure, the resonant output cavities should be able to handle high peak power (up to 1 GW/m) and short pulses (<50 nsec). The rf power transfer must be controlled so that the transfer cavity surface does not breakdown In addition, other characteristics of the transfer cavity which must be taken into account in the design are the size of the pipe diameter (large enough to avoid transverse instability of the electron beam that could preclude its transport through the power transfer structures, but small enough so that the field is localized at the cavity), minimization of the wakefield effects on electron bunches and the effect of thermal loads on the cavity walls.

The microwave energy at the output cavities is channeled through the transfer waveguides 40 to the high gradient structure 30 where an intense beam of electrons generated by a gun 42 is accelerated to a high energy and emitted at end 44.

The design objective of the high gradient structure is to maximize the field gradient without surface breakdown and is affected by the power source under consideration. The high peak power and short pulse length in the relativistic klystron requires disk loaded structures with high group velocity. These structures are effective in reducing wall losses and, hence, in increasing efficiency. From the viewpoint of the electrodynamic structure, the disk hole size should be small to preserve the mode contents. On the other hand, in order to minimize the transverse wakefield effects, the holes should be enlarged. Likewise, the structure should have high Q-values for the accelerating mode in order to keep the electromagnetic pulse in the structure for a sufficient long time. However, if the wakefield effects become serious, the Q-values of the transverse modes of the structure may have to be lowered. There are several techniques for damping the transverse modes. One technique is to use slot or circumferential couplings to the accelerating cavities with waveguides of the appropriate cutoff frequencies. Another technique is to use beatings of transverse wakes produced by two different sets of accelerating structure to provide stable nulls where the electron bunchers can be placed.

The microwave fill time of the structure must match that of the output cavities. This can be done by careful spacing of the end plates in the structure to control the length of an accelerator section. In addition, depending on the operational frequency, several output cavities could be combined before coupling into the structure.

Bending magnets and quadrupole magnets are used to guide and focus the electron beam from the RK/HGA into a superconducting synchrotron radiation ring. The RK/HGA and the synchrotron ring may be stacked on top of each other to minimize the overall length of the apparatus. Standard methods of producing X-rays in the synchrotron ring have been described hereinabove.

By utilizing the relativistic klystron to drive the accelerator 30, the length along its longitudinal axis is substantially reduced. For example, to produce electrons having an energy level of 50 MeV, the length of accelerator 30 along its longitudinal axis is about 2 meters. To produce electrons having an energy level of 200 MeV, the length of accelerator 30 along its longitudinal axis is about 3 meters. The overall length of the apparatus shown in FIG. 3 (the non-stacked configuration) is in the range from about 5 meters to about 10 meters. In the stacked configuration, the overall length of the apparatus is in the range from about 3 meters to about 5 meters.

Two publications which discuss in detail the use of relativistic klystrons as a power source for high gradient accelerator applications are the articles *Relativistic Klystron Research for High Gradient Accelerators*, M. A. Allen et al., SLAC-PUB-4650, LLNL Report UCRL-98843, June, 1988; and *The Relativistic Klystron Two-Beam Accelerator*, A. M. Sessler and S. S. Yu, Physical Review Letters 58, 2439 (1987).

The present invention thus provides improved apparatus for generating X-rays particularly useful in fabricating integrated circuits having significantly increased circuit density. The use of a relativistic klystron to drive a high gradient accelerator and coupling the high energy electrons generated thereby to a synchrotron storage ring, particularly a ring which has superconducting magnets, enables the overall physical size of the X-ray generating apparatus to be small enough to be used by commercial integrated circuit fabricators and other users in a cost effective manner.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed:

1. Apparatus for generating high intensity X-rays comprising:

a relativistic klystron;

a high gradient linear accelerator driven by said relativistic klystron for producing high energy electrons; and an electron storage ring responsive to the electrons injected therein by said accelerator for generating high intensity X-rays.

2. The apparatus of claim 1 wherein said storage ring comprises a synchrotron radiation ring.

3. The apparatus of claim 2 wherein said synchrotron radiation ring comprises superconducting magnets.

4. The apparatus of claim 1 wherein the electrons generated by said accelerator have an energy level in the range from about 50 MeV to about 200 MeV.

5. The apparatus of claim 1 wherein the length of said accelerator along its longitudinal axis is about 2 meters, corresponding to an energy level of about 50 MeV.

6. The apparatus of claim 1 wherein the length of said accelerator along its longitudinal axis is about 3 meters, corresponding to an energy level of about 200 MeV.

7. A method of generating high intensity X-rays comprising the steps of:

generating high energy electrons using a relativistic klystron driven high gradient accelerator; and injecting said high energy electrons into an synchrotron radiation ring, bending of the electrons within said radiation ring causing X-rays to be emitted therefrom.

8. The method of claim 7 wherein the electrons generated by said relativistic klystron driven high gradient accelerator have an energy level in the range from about 50 MeV to about 200 MeV.

9. The method of claim 7 wherein the X-rays generated by said radiation ring are directed to semiconductor wafer steppers positioned a predetermined distance therefrom.

* * * * *

UNITED STATES PATENT AND TRADEMARK OFFICE

CERTIFICATE OF CORRECTION

PATENT NO. : 4,961,056

DATED : October 2, 1990

INVENTOR(S) : David U.L. Yu

It is certified that error appears in the above-identified patent and that said Letters Patent is hereby corrected as shown below:

IN THE DRAWING

Figure 1 is corrected by inserting the legend --PRIOR ART-- as shown in the attached sheet of drawing.

Signed and Sealed this

Eighteenth Day of February, 1992

*Attest:*

HARRY F. MANBECK, JR.

*Attesting Officer*

*Commissioner of Patents and Trademarks*